United States Patent [19]

Mercer

[11] 4,068,871

[45] Jan. 17, 1978

[54] LATCH OPERATING MECHANISM

[75] Inventor: Robert R. Mercer, Ortonville, Mich.

[73] Assignee: General Motors Corporation, Detroit, Mich.

[21] Appl. No.: 738,603

[22] Filed: Nov. 3, 1976

[51] Int. Cl.[2] ..... E05C 9/00

[52] U.S. Cl. ..... 292/48; 292/50; 292/214; 292/223; 292/225; 297/379; 292 DIG. 61;

[58] Field of Search ..... 292/26, 30, 28, 41, 292/36, 53, 38, 48, 119, 50, 127, 97, 227, 82, 84, 123, 125, 141, 158, 167, 171, 223, 225, 196, DIG. 61, DIG. 62, 11, 56, 25, 116, 214; 297/379

[56] References Cited

U.S. PATENT DOCUMENTS

| | | | |
|---|---|---|---|
| 1,693,481 | 11/1928 | Harper | 292/48 |
| 1,884,201 | 10/1932 | Phillippe | 292/41 |
| 2,117,339 | 5/1938 | Claud-Mantle | 292/123 |
| 2,146,700 | 2/1939 | Peterson | 292/48 |
| 2,207,441 | 7/1940 | Rhodes | 292/223 |
| 2,223,760 | 12/1940 | Haaser | 292/48 |
| 2,541,352 | 2/1951 | Ginter | 292/50 X |
| 3,112,946 | 12/1963 | Wernig et al. | 292/223 |
| 3,177,022 | 4/1965 | McKee et al. | 292/50 |

FOREIGN PATENT DOCUMENTS

| | | | |
|---|---|---|---|
| 1,261,587 | 4/1961 | France | 292/38 |
| 10,710 | 9/1912 | United Kingdom | 292/48 |

*Primary Examiner*—Roy D. Frazier
*Assistant Examiner*—Rodney H. Bonck
*Attorney, Agent, or Firm*—Charles E. Leahy

[57] ABSTRACT

A one-piece continuous resilient rod extends between spaced apart latch bolts and has its ends operatively connected to the latch bolts. The unrestrained free length of the rod exceeds the spaced relation between the latched positions of the latch bolts so that the rod is flexed and resiliently biases the latch bolts to their respective latched positions. A rotatably journalled handle engages the rod intermediate the latch bolts. Rotation of the handle flexes the rod, and shortens its effective length to withdraw the ends of the flexible rod toward each other and simultaneously move the latch bolts from their latched position to their unlatched position. An integral coil compression spring may be provided in the continuous rod.

3 Claims, 4 Drawing Figures

LATCH OPERATING MECHANISM

The invention relates to a latch operating mechanism and more particularly to a mechanism for operating a pair of latch bolts.

It is well known to provide latches for maintaining the desired position of hinged members such as vehicle body hoods and seat backs. A typical latch for such an application includes a striker mounted on a stationry member and a latch bolt movably mounted on the other member for movement between a latched position engaging the striker and an unlatched position. Furthermore, it is known to provide latch bolts at opposite edge portions of the movable member. A spring associated with each latch bolt urges movement to the latched position. An operating handle is rotatably journalled intermediate the latch bolts and connecting rods extend between the handle and each of the latch bolts. Rotation of the handle actuates the rods to in turn move the latch bolts against the spring force from their latched position to their unlatched position. The relief of actuating force on the handle permits the springs to return their respective latch bolts to the latched position.

According to the present invention a one-piece continuous resilient rod extends between the latch bolts and has its ends operatively connected to the latch bolts. The unrestrained free length of the rod exceeds the spaced relation between the unlatched positions of the latch bolts so that the rod is flexed and resiliently biases the latch bolts to their respective latched positions. A rotatably journalled handle engages the rod intermediate the latch bolts. Rotation of the handle flexes the rod, and shortens its effective length to withdraw the ends of the flexible rod toward each other and simultaneously move the latch bolts from their latched position to their unlatched position. An integral coil compression spring may be provided in the continuous rod.

One feature, object, and advantage of the invention is the provision of a continuous rod extending between spaced apart latched bolts and providing an integral biasing action urging the latch bolts to their respective latched positions.

A further object, feature, and advantage of the invention is the provision of a continuous rod extending between spaced latch bolts and a rotatable handle for resiliently flexing the rod to withdraw the ends of the rods and thereby operate the latch bolts from latched to unlatched positions.

These and other objects, features, and advantges of the invention will become apparent upon consideration of the specification and the appended drawings in which.

Figure 1:
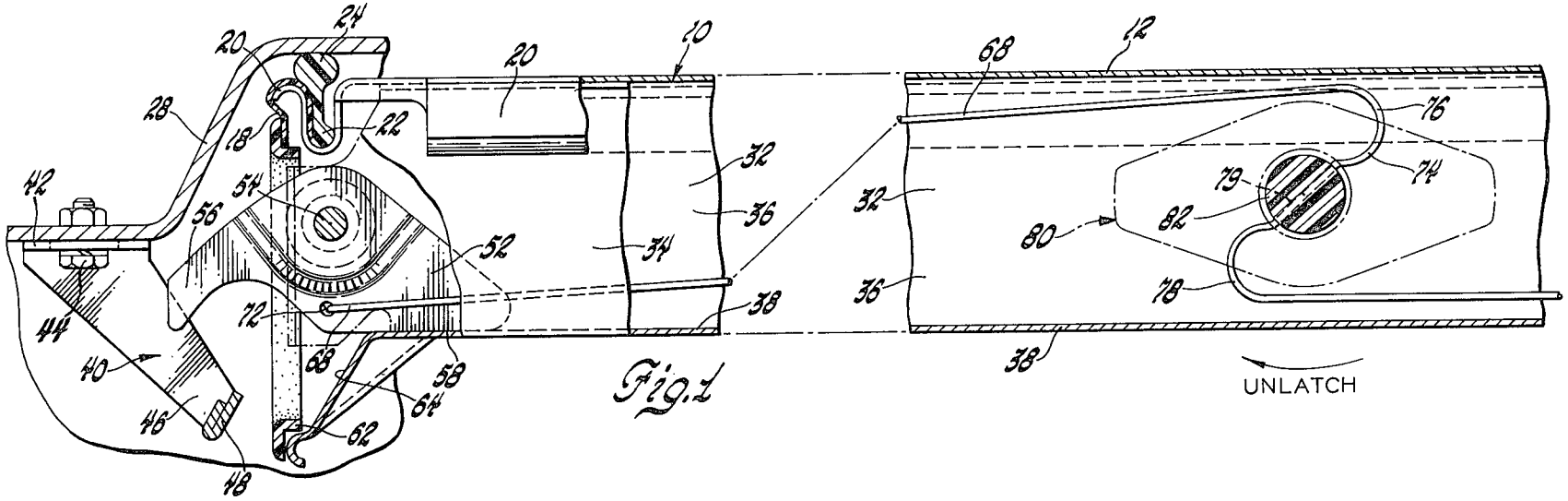
FIG. 1 is a plan view through a seat back having a latch mechanism according to the invention.

Referring to FIG. 1 there is shown a vehicle seat back generally indicated at 10 and including a sheet metal seat back pan 12 which supports a seat cushion 14 conventionally provided by a resilient foam cushion 16 covered by a seat covering 18. The seat back 10 is pivoted to the vehicle body at its lower end so that it may be folded forwardly to a horizontal position wherein the pan 12 provides a cargo floor. The seat back pan 12 has an S-shaped integral reinforcing flange 20 extending around its peripheral edge. The edges of the seat covering 18 are connected to the flange 20 by a vinyl retainer strip 22 which is adhesively secured to the pan 12. The retainer strip 22 has a body portion 24 which seats against a support panel 28 of the vehicle body to define the normal upright seating postion of the seat back 10. A hat section reinforcement 32 extends transversely of the seat back pan 12 and is welded thereto. The reinforcement 32 includes vertically spaced horizontal upper and lower walls 34 and 36 and a connecting vertical wall 38.

Figure 4:
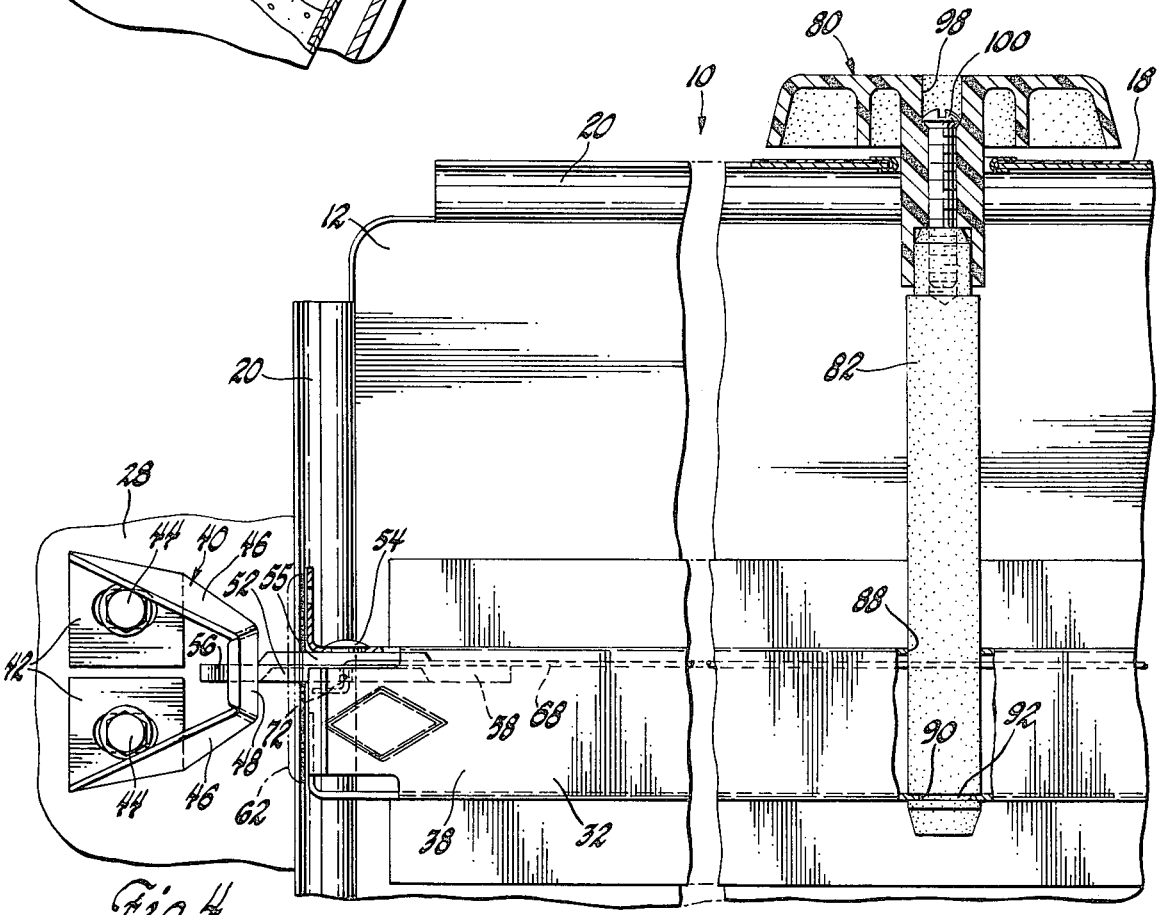
FIG. 4 is a frontal elevation view taken in the direction of arrows 4—4 of FIG. 3 and having parts broken away and in section.

Referring to FIGS. 1 and 4 a striker 40 has feet 42 attached to the support panel 28 by bolts 44. Striker 40 also has spaced legs 46 which support a vertically extending striker wall 48. A bolt 52 has a raised boss 55 which is pivotally mounted on the upper leg 34 of reinforcement 32 by a rivet 54. As best seen in FIG. 1 the bolt 52 has a latch finger 56 which is engageable with the striker wall 48 to limit forward pivoting movement of the seat back 12 toward its cargo floor position. The latch bolt 52 also has an abutment wall 58 which is engageable with the vertical wall 38 of reinforcement 32 to limit pivoting movement of bolt 52 in the clockwise direction as viewed in FIG. 1, and thereby establish the latched position of the latch bolt 52.

The end of the seat back has a plastic escutcheon 62 providing an opening through which the bolt 52 is movable. The bolt 52 is pivotally movable about the rivet 54 to an unlatched position of FIG. 2 wherein the latch finger 56 is withdrawn into the seat back 10 to terminate its latching coaction with the striker wall 48. The vertical wall 38 of reinforcement 32 is flared outwardly at its end and provides an abutment face 64 engageable by the end of latch finger 56 to limit pivoting of bolt 52 in the unlatching counterclockwise direction.

It will be understood that the drawings herein disclose only one end of the seat back 10. The unshown end of the seat back has an identical bolt and striker assembly associated therewith. It will be understood however that the bolts are rotated in opposite directions of rotation to effect simultaneous actuation to a selected latching or unlatching position.

As best seen in FIG. 1 the laterally spaced latch bolts 52 are connected by a continuous flexible rod 68. Referring to FIG. 4 the end of rod 68 is bent and inserted through an aperture 72 of latch bolt 52 to effect a connection with the latch bolt. A like connection is made between the other end of the rod 68 and the opposing latch bolt 52. As seen in FIG. 1 the rod 68 has a tortuous S-shaped bend 74 at the center portion intermediate its ends, and including loops 76 and 78 connected by a straight portion 79.

Figure 3:
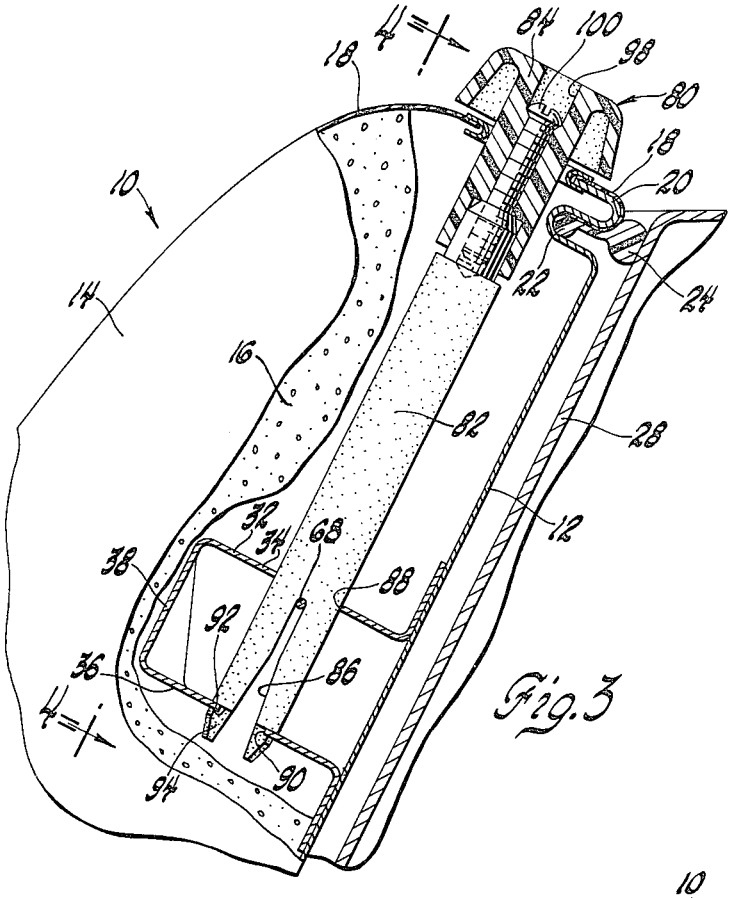
FIG. 3 is a side elevation view of the seat back latch mechanism having parts broken away and in section.

A handle assembly 80, best seen in FIG. 3, engages the straight portion 79 of rod 68 at the center of the S-shaped bend 74. The handle assembly 80 includes a plastic shank 82 and knob 84. The shank 82 is generally cylindrical and has a slot 86 at its lower end for receiving the straight portion 79 of rod 68. The upper wall 34 of reinforcement 32 has an aperture 88 which rotatably receives the cylindrical body of shank 82. The lower wall 36 of reinforcement 32 has an aperture 90 which is smaller than the cylindrical body of shank 82. The slot 86 and a beveled end face 94 of the shank 82 permit the shank 82 to flex and snap through the aperture 90 so that the aperture walls extend into a circumferentially extending groove 92 and thereby retain the shank 82 in the seat back 10. The knob 84 has a central recess 98 which receives a screw 100 to attach the knob 84 to the shank 82. Splines or an equivalent anti-rotational connection is preferably provided at the interface between the knob 84 and shank 82.

Referring again to FIG. 1 it will be understood that the rod 68, when positioned as shown therein, is in a stressed state whereby it urges rotation of bolt 52 in the clockwise latching direction while the opposite unshown bolt is also biased in its latching direction. This biasing effect of the rod 68 may be provided by the rod being bowed along its length between the end attached to the bolt and its S-shaped bend 74. In the alternative, the flexure effort may be provided by the spring character of the rod at the S-shaped bend 74 which attempts to open the loops 76 and 78 of the S-shaped bend 74. Rotating movement of the handle assembly 80 in the clockwise direction of FIG. 1 will first remove the biasing effect from the latch bolts 52 and then withdraw the ends of the rods 68 to rotate the latch bolts from their latched position of FIG. 1 to their unlatched position of FIG. 2. Movement of latch bolts 52 to their unlatched position permits forward pivoting movement of the seat back 10 to a cargo floor position. Release of pivoting effort from the handle assembly 80 allows the rod 68 to return the latch bolts 52 to their latched positions.

Figure 2:
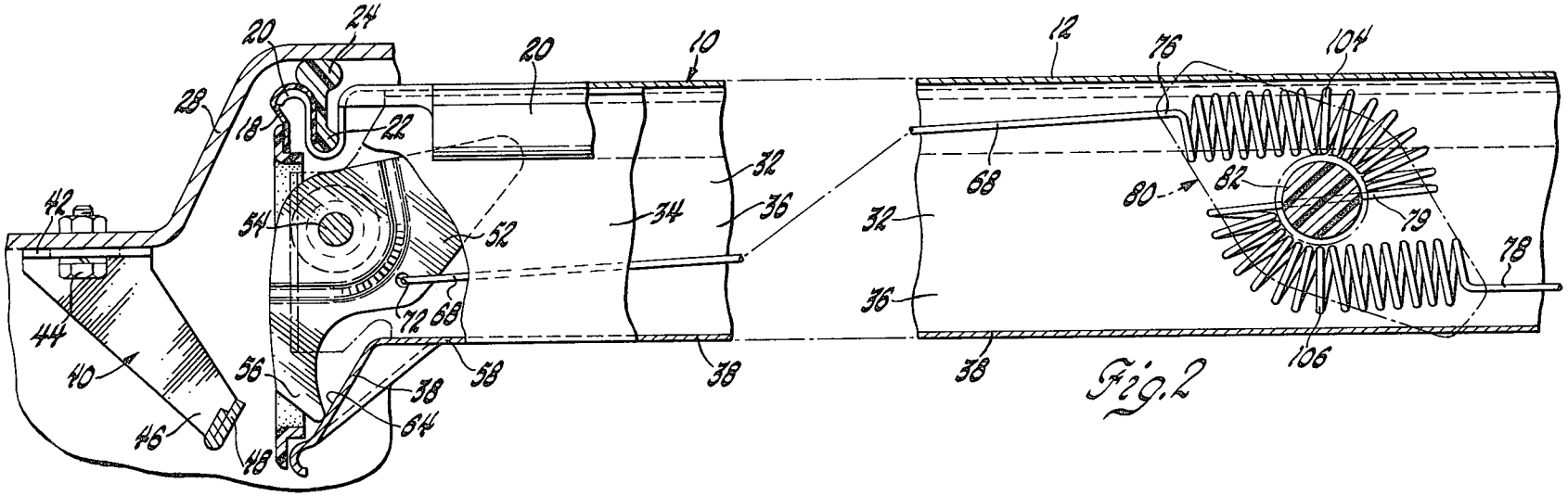
FIG. 2 is a view similar to FIG. 1 but showing modification of the latch connecting rod and the latch bolts moved to their unlatched positions.

FIG. 2 shows a modified form of the connecting rod 68 wherein integral coil spring portions 104 and 106 are provided in the connecting rod 68 adjacent the straight portion 79.

The coil springs 104 and 106 yield to permit overtravel of the handle 80 after the latch bolt 52 is stopped at the unlatched position of FIG. 2 by engagement of the latch finger 56 with the abutment face 64 of reinforcement 32.

It is to be understood that although the latch operating mechanism of this invention is described herein as a seat back latch, it may be employed in any application where oppositely disposed latch bolts are employed. Furthermore, the latch operating mechanism may be used with latch bolts which are mounted for rectilinear motion as well as rotary motion.

What is claimed is:

1. A latch mechanism acting between a first member and a second member movable relative the first member, said latch mechanism comprising:

first and second latch bolts movably mounted on one of the members for movement between a latched position engaging the other member and an unlatched position permitting movement of the second member relative the first member;

a continuous flexible rod having one end connected with one latch bolt and a second end connected with the other latch bolt, said flexible rod providing the sole operating connection between the first and second latch bolts and resiliently urging the first and second latch bolts to their respective latched positions and a handle journalled for rotation on the member to which the first and second latch bolts are movably mounted, said handle being operatively connected with the flexible rod so that rotation of the handle flexes the flexible rod to move the first and second latch bolts from the latched position to the unlatched position.

2. A latch mechanism acting between a first member and a second member movable relative the first member, said latch mechanism comprising:

first and second latch bolts movably mounted in spaced relation on one of the members for movement between a latched position engaging the other member and an unlatched position permitting movement of the second member relative the first member;

a continuous resilient flexible rod having one end connected to the first latch bolt and a second end connected to the second latch bolt, said flexible rod having a length exceeding the spaced relation between the first and second latch bolts and being flexed when the latch bolts are disposed in their respective latched positions so that the flexible rod provides a resilient biasing effort to maintain the latch bolts in their respective latched positions;

and an operating handle journalled for rotation on the member to which the first and second latch bolts are movably mounted, said handle being operatively connected with the flexible rod so that rotation of the handle further flexes the flexible rod thereby shortening the effective length to withdraw the ends of the flexible rod toward each other and move the first and second latch bolts from the latched position to the unlatched position.

3. A latch mechanism acting between a first member and a second member movable relative the first member, said latch mechanism comprising:

first and second latch bolts movably mounted on one of the members for movement between a latched position engaging the other member and an unlatched position permitting movement of the second member relative the first member;

a continuous flexible rod having one leg connected with the first latch bolt and a second leg connected with the second latch bolt to provide the sole operating connection therebetween and to resiliently urge the first and second latch bolts to their respective latched positions, each leg of said flexible rod having an integral coil spring interposed therein with the axis of the coil springs being coaxial with the axis of the flexible rod, and a handle having a shaft journalled for rotation on the member to which the first and second latch bolts are movably mounted, said shaft having a slot receiving the flexible rod intermediate the coil springs so that rotation of the handle flexes the coil springs and moves the first and second latch bolts from their latched position to the unlatched position.

* * * * *